US006726203B1

(12) United States Patent
Michel et al.

(10) Patent No.: US 6,726,203 B1
(45) Date of Patent: Apr. 27, 2004

(54) SHEET GUIDE ARRANGEMENT IN A PRINTING MACHINE

(75) Inventors: Peter Michel, Muhlheim (DE); Petra Franz, Offenbach (DE); Stefan Hartmann, Offenbach-Rumpenheim (DE); Peter Wulf, Cologne (DE)

(73) Assignee: MAN Roland Druckmaschinen AG, Offenbach/Main (DE)

( * ) Notice: Subject to any disclaimer, the term of this patent is extended or adjusted under 35 U.S.C. 154(b) by 0 days.

(21) Appl. No.: 09/830,249

(22) PCT Filed: Oct. 2, 1999

(86) PCT No.: PCT/EP99/07318

§ 371 (c)(1),
(2), (4) Date: Jun. 11, 2001

(87) PCT Pub. No.: WO00/26031

PCT Pub. Date: May 11, 2000

(30) Foreign Application Priority Data

Oct. 30, 1998 (DE) ..... 298 19 402 U

(51) Int. Cl.[7] ..... B65H 5/00
(52) U.S. Cl. ..... 271/264; 101/142; 101/232
(58) Field of Search ..... 271/264, 96, 275; 101/142, 232

(56) References Cited

U.S. PATENT DOCUMENTS 3,592,329 A * 7/1971 Fleischauer ..... 138/105
5,133,255 A * 7/1992 DeMoore et al. ..... 101/183
5,634,636 A * 6/1997 Jackson et al. ..... 271/184
5,839,722 A * 11/1998 Berlin et al. ..... 269/309
5,931,093 A * 8/1999 Walther et al. ..... 101/232
6,170,819 B1 * 1/2001 Crosby et al. ..... 271/195
6,279,898 B1 * 8/2001 Stephan ..... 271/195

FOREIGN PATENT DOCUMENTS

| | | | |
|---|---|---|---|
| DE | 42 44 499 C2 | | 7/1994 |
| DE | 0 198 29 094 A1 | * | 1/2000 |
| DE | 0 987 206 A2 | * | 3/2000 |
| EP | 0 156 173 B1 | | 12/1989 |
| EP | 0 502 417 A1 | | 9/1992 |

* cited by examiner

*Primary Examiner*—Donald P. Walsh
*Assistant Examiner*—Joseph Rodriguez
(74) *Attorney, Agent, or Firm*—Leydig, Voit & Mayer, Ltd.

(57) ABSTRACT

An air assisted sheet guide device in a printing machine which is operable during either positive pressure (blast) air operation as well as suction air operation to permit reliable and stable sheet guidance with reduced air flow turbulence. The sheet guide device includes at least one module that defines a guide surface having air flow openings therein and an air flow channel, and a pneumatic system for creating either a positive or suction pressure generated air flow in the flow channel. One or more plate-like air directional elements are mounted within the air flow channel which create a uniform pressure distribution on the guide surface during positive (blast) air operation and which more uniformly direct air to the pneumatic system during suction pressure operation.

6 Claims, 3 Drawing Sheets

SHEET GUIDE ARRANGEMENT IN A PRINTING MACHINE

FIELD OF THE INVENTION

The present invention relates generally to a sheet guiding device for guiding sheets between units of a printing machine, and more particularly, to an air assisted sheet guiding device.

BACKGROUND OF THE INVENTION

EP 0 156 173 B1 discloses a sheet guide device or arrangement for guiding sheet material that is printed on one or on both sides. This guide arrangement is formed by modularly arranged flow channels which have openings that define air nozzles in a guide surface. The flow channels have a plurality of fans for supplying positive pressure (blowing or blast) air or suction air.

DE 42 44 499 C2 also discloses a sheet guide arrangement with openings for the passage of air. A positive pressure (blast) or suction box presents guide or cover surfaces connected by means or blast/suction air connecting members with a blast-air or a suction-air source. From the cover surface, flow resistance-forming bodies extend into the blast and suction air box. With increasing distance from the orifice zone of the blast or suction connecting member the flow resistance state of the above-mentioned bodies in the blast or suction box decreases. Here, it proves disadvantageous especially in blast-air operation, with this arrangement of the flow resistance-forming bodies because turbulence arises in the region of the passage openings, which can lead to unstable passage of the sheets.

OBJECTS AND SUMMARY OF THE INVENTION

An object of the present invention is to provide a sheet guide arrangement in a printing machine which eliminates the foregoing disadvantages, which enables secure and stable sheet guidance, especially in the blast-air operation, as well as also in suction-air operation, and which reduces the creation of turbulence.

A first advantage of the invention lies in that the sheet-conducting print material can be uniformly and reliably guided free from smudging in the blast-air as well as in the suction-air operation of the sheet guide arrangement. By means of the inventive construction of the sheet guide arrangement, turbulence is avoided in the region of the air openings, so that in the blast-air operation a stable air cushion with substantially uniform pressure distribution emerges from openings in the guide surface and develops between the guide surface of the sheet guide device and one side of the sheet-form print material. The danger of smearing is thereby reduced, since the air flow, which preferably diffuses an air cushions guides the print material with essentially uniform pressure distribution.

It is advantageous, furthermore, that the sheet guide arrangement can also be operated in suction air operation. In that case, the side of the print material, which preferably is unprinted, is uniformly drawn in the direction of the guide surface of the sheet guide arrangement.

The air supply for the sheet guide arrangement preferably is a reversible regulatable pneumatic system, which permits a positive pressure or suction-air supply. Alternatively, reversibly operable, variable speed fans may be used for directing or drawing the air.

The guide sheet arrangement is located in the printing machine adjacent the sheet transport systems—which in this_case includes gripper bridges-on the sheet guide cylinders (i.e., contact drum, transfer cylinder, printing cylinder, and turning system) at a defined spacing, whether it be straight or curved. Moreover, the sheet guide arrangement can be positioned underneath, as well as above sheet-conducting cylinders, drums, or circulating conveyor systems.

A further advantage of the sheet guide arrangement is that by virtue of directional elements the air flow stream and pressure distribution can be controlled over the sheet-conducting surface. The air introduced into a flow channel from the particular pneumatic system can be controlled in a uniform manner with uniform pressure distribution inside the flow channel, which enables more stable support for the passing sheets. By an air-permeable construction, for example a perforation of the directional elements, possible recirculation of the air flow is eliminated and a stabilizing of the flow in the flow channel is achieved. By means of an inclined arrangement of the directional elements (or portions thereof), air may be directed into or drawn from the flow channel at a predetermined angle by the pneumatic system, and by use of air permeable materials such as perforated materials with portions or corners cut away the air flow in the channel may be reduced. This likewise can lead to a uniform pressure distribution of the flow channel.

The guiding surface of the sheet guide arrangement may be formed as an air-permeable guide surface with passage openings for transverse air flow. By means of such air-permeable guide surface diffused air flows can be generated that act upon the underside and/or the upper side of a sheet-form printing material, in the form of blast-air or suction-air flows.

Other objects and advantages of the invention will become apparent upon reading the following detailed description and upon reference to the drawings, in which:

Figure 1:
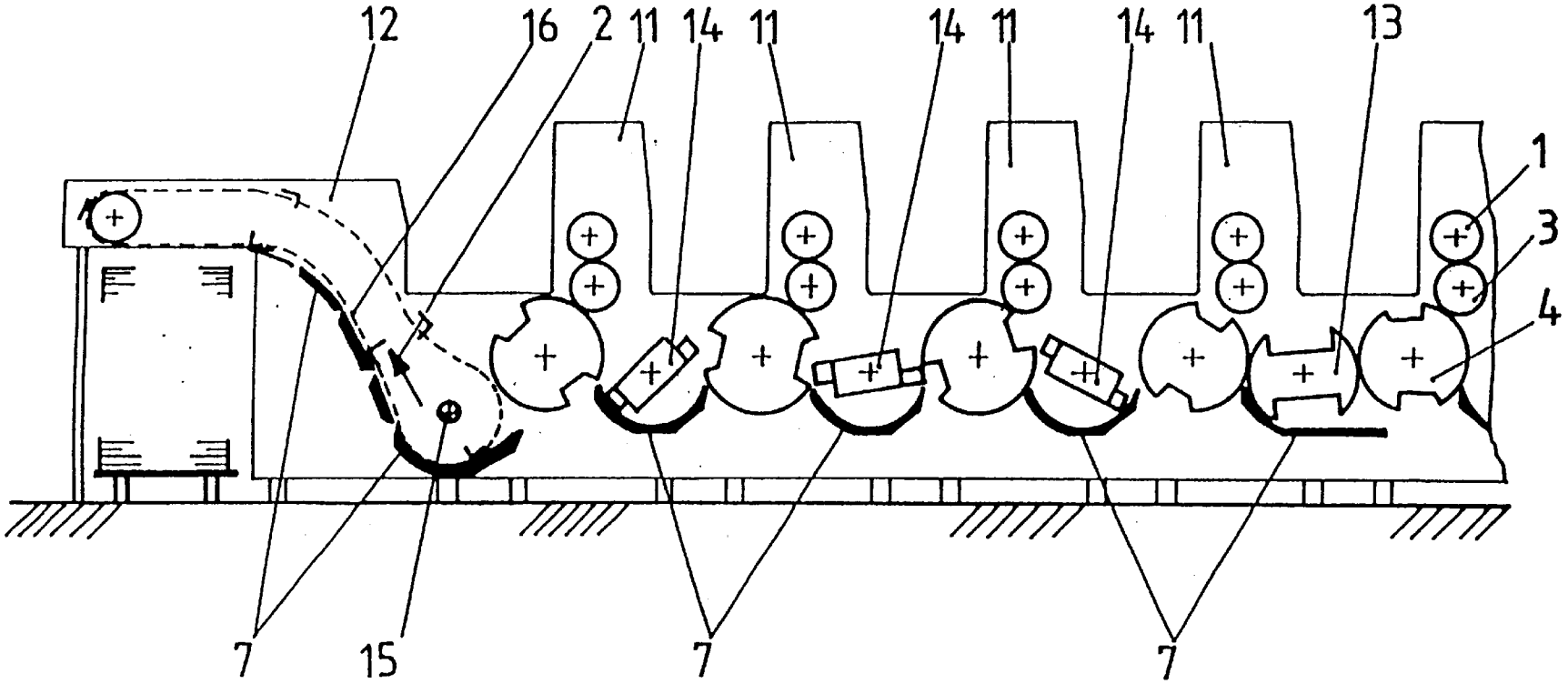
FIG. 1 is a schematic side elevation view of a rotary printing machine having a sheet guide arrangement in accordance with the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DESCRIPTION OF PREFERRED EMBODIMENTS

Referring now more particularly to the drawings, there is shown an illustrative rotary printing machine which in this case has a series construction, comprising a plurality of printing units 11 for offset printing, and preferably polychrome offset printing. In addition, at least one lacquering mechanism or other processing station can be arranged after the last printing unit. Each printing unit 11 in this case includes a plate cylinder 1, a rubber blanket cylinder 3, as well as a sheet guide cylinder, which in this instance is a pressure cylinder 4. Each plate cylinder 1 has a respective inking system and possibly a dampening or moistening system. Between the printing units 11 there are arranged as sheet guide cylinders, one or more turning systems 13 (for example either a single-drum or three-drum turning system), as well as transfer cylinders 14. For transferring sheets from the last printing unit 11 (or the final lacquering unit as the case may be), to a sheet stacker 12, a circulating conveyor system 16 is provided, which in this case includes a chain drive with a chain wheel shaft 15.

For guiding sheets in their conveyance direction 2 through the printing units, sheet guide devices 7 are located at defined spacings, adjacent to the sheet guide cylinders (feed drum, turning system 13, transfer cylinder 14, print-pressure cylinder 4), as well as adjacent the conveyance system 16. These sheet guide devices 7 are arranged next to each other in a modular arrangement, and they extend over the maximum format width of the sheet-form print material 18. The sheet guide devices 7 have guide surfaces 8, which are provided with transverse air openings. Each guide surface 8 forms there a continuous (straight and/or curved) plane for the guidance of the print material 18.

The sheet guide devices 7, constructed in a modular manner, preferably being formed by a plurality of guide modules 5, 9. In the illustrated embodiment the guide module 5 preferably is located underneath the conveyance plane of the print material, and the guide module 9 is located above the conveyance plane or the print material. The basic construction of the modules 5, 9 is the same in both instances. Each guide module 5, 9 has a flow channel 17 which communicates with the guide surface 8 as well as, in each case, a pneumatic system 10 for the blast-air or the suction-air supply. The pneumatic system 10, for example, may be a central air supply, or comprise a plurality of fans arranged on the rear wall of the flow channels 17. The guide surface 8 is preferably detachably connected with the flow channel 17 and it forms the cover surface for the sheet-form print material 18 over the flow channel 17.

Figure 2:
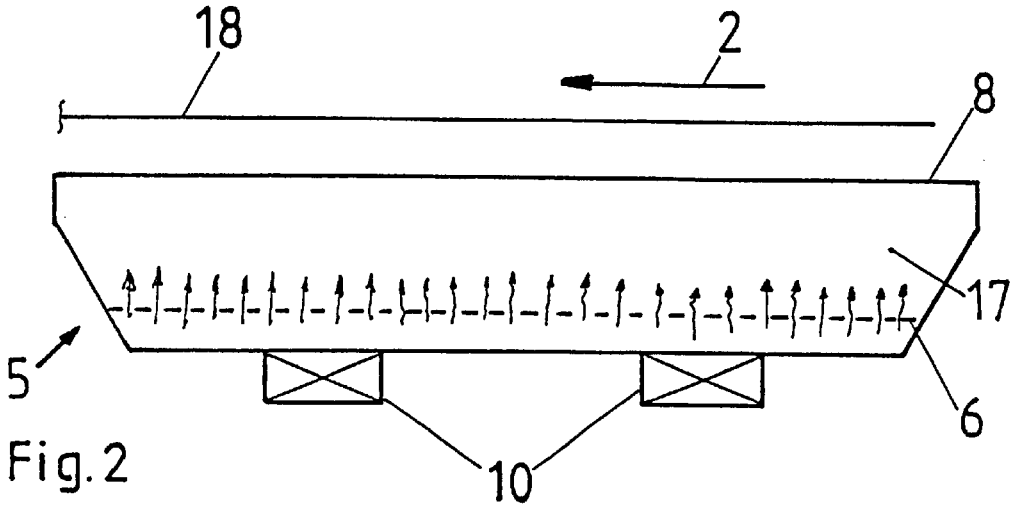
FIG. 2 is side elevational view of a module of one of the sheet guiding arrangement of the printing machine shown in FIG. 1.

In accordance with the invention, each sheet guide device has at least one air directional guide or element associated with the pneumatic system in the flow channel for providing even distribution of pressure on the guide surface during the positive pressure (blast) air operation and for enabling more even and reliable suction air flow at the guide surface during suction operation. More particularly, inside each flow channel 17 there is provided at least one directional element 6 for the pneumatic system 10. According to one embodiment, as depicted in FIG. 2, the directional element 6 may be in the form of a perforated plate that extends longitudinally within the flow channel 17, adjacent, or in closely spaced relation, to the top_of the pneumatic system 10. The perforated plate in this case has a constant perforation pattern. Alternatively, the perforation pattern may be varied, i.e., the transverse air openings being formed differently in size and/or spacing.

Figure 3:
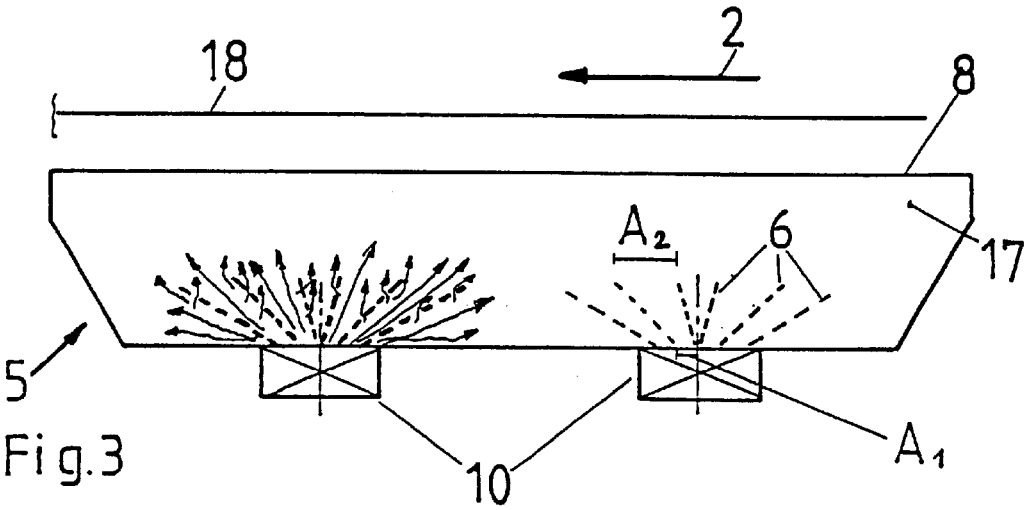
FIG. 3 is an alternative embodiment of a module of the sheet guiding arrangement.

In the second embodiment, as depicted in FIG. 3, the directional element 6 is constructed as a central or conical air guide surface concentrically located adjacently to the pneumatic system 10. Similarly, a multiple arrangement of concentrically mounted directional elements per pneumatic system 10 can be provided in the flow channel 17. In this case, the air guiding surfaces of the directional elements 6 may be made flat and/or curved. Between two directional elements 6 the spacings $A_1$, $A_2$ of the air guiding surfaces are larger as their distance ($A_2$, $A_1$) from the pneumatic system 10 increases. The air guide surfaces can likewise form surfaces with flow control edges arranged remote from the pneumatic system 10. As a further embodiment, the air guiding surfaces of the directional elements 6 may be constructed with openings (for example bores, slits, pores or a porous material) for the_transverse passage of air.

Figure 4:
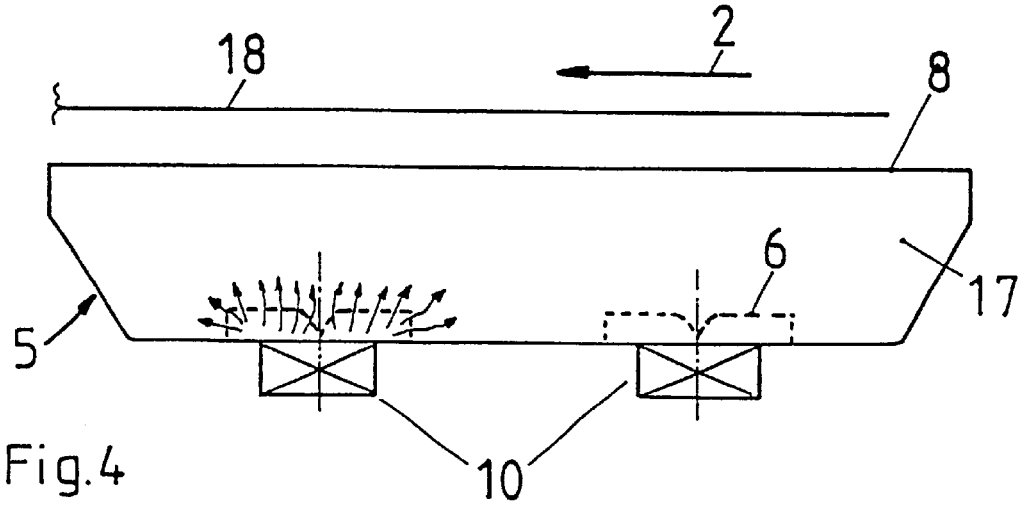
FIG. 4 is a further alternative embodiment of a module of the sheet guiding arrangement.

In a third embodiment, as depicted in FIG. 4, a directional element 6 associated with the respective pneumatic system 10 is a hood-shaped attachment with air passage openings (for example bores, slits, pores). The hood form attachment defines a chamber within the flow channels 17, out from which the air flows during positive pressure or blast-air operation. In suction-air operation, the air is drawn over and into the hood surface to the pneumatic system 10.

The embodiments, as depicted in FIGS. 2 to 4 are usable, for example, with the guide modules 5 placed underneath sheet-conveying cylinders 4, 14, or under the circulating conveyance systems 16.

Figure 5:
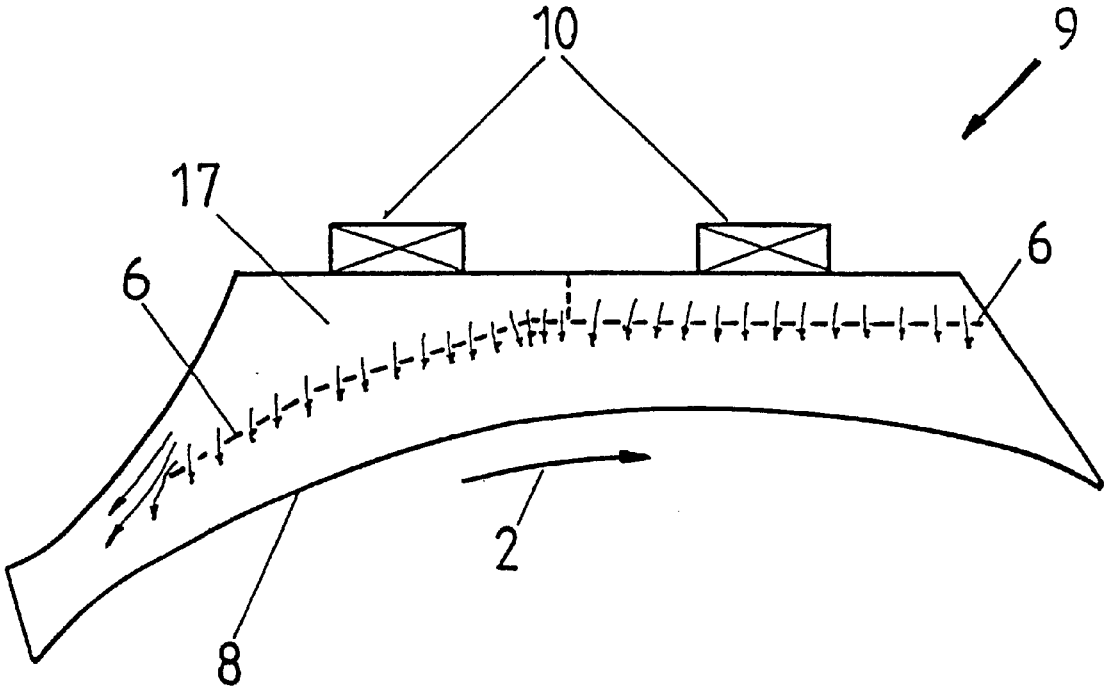
FIG. 5 is still another alternative embodiment of a module of the sheet guiding arrangement.

In the fourth embodiment, as depicted in FIG. 5, there is shown a guide module 9 that is usable above the sheet-conducting cylinders 4, 14 or above the circulating conveyance systems 16. A directional element 6 in the form of a perforated plate is mounted within the pneumatic system 10. The hole pattern of the perforated plate can be formed in a constant or uniform pattern, or, as already described, in a varying pattern. The extent of the perforated plate is limited, however, so that the part of the guide surface 8 farthest remote from the pneumatic system 10 can be supplied with sufficient air, preferably blast air.

The described directional elements 6 in the flow channel 17 serve for the generation of a uniform pressure distribution (impulse flow distribution) desirable for the particular type of operation over the entire guide surface 8. In blast-air operation, the air flow specifically introduced by the pneumatic system(s) 10 into the flow channel 17, is purposefully aimed by means of directional elements 6, in order to ensure reliable and stable sheet guidance. Also in suction-air operation, the air drawn off into the flow channel 17 is specifically directed, which brings about an even, stabilized sheet conduction. Troublesome recirculation flows or short circuiting of air flows are avoidable by means of the directional elements 6 and by means of the arrangement and design of these directional elements 6, especially through transverse air perforations or porous openings.

By means of the directional elements 6 in blast-air operation the flow'specifically introduced from the pneumatic system 10 is purposefully aimed at, and distributed within, the flow channel 17. Printed materials 18 can be conducted stably and free from smudging, with the printed or lacquered side facing the sheet guide device 7. In suction-air operation the flow specifically drawn off from the pneumatic system 10 is first distributed within the flow channel 17. Especially by means of the openings in the respective directional element 6 there is prevented the possibility that the flow will become misdirected at the edges of the guide surface, and form troublesome recirculation or turbulent zones that disturb the pressure distribution. According to the type (size, spacing) of the openings on the directional element 6, the passage resistance is variable. The suction-air operation is stable, especially for print materials 18 with unprinted or unlacquered side facing the sheet guide device 7. For purposes of illustration, in FIG. 3 and 4 the air flow is indicated by arrows only on the left-directional element 6.

The operation of the printing machine is as follows: the sheet-form print material 18 runs in conveyance direction 2 through the printing units 11, possibly (through) lacquering mechanisms or further processing stations, and is deposited on a stack at the stacking station 12. In order to ensure a smudge-free conveyance of the print material 18, the guide modules 5, 9 of the sheet guide device 7 are acted upon pneumatically.

In the blast-air operation, an excess pressure is built up in the respective flow channel 17 by at least one pneumatic system 10, which flow emerges from the guiding surface 8 as a diffusing positive pressure air flow. The sheet-form print material 18 is uniformly guided over the format by the resulting diffusing air cushion. By means of this stable air flow, subpressure zones that cause flattening of the sheet-form print material are avoided. The sheet guide device 7, moreover, also is operatable in suction-air operation. The sheet guide device 7 therefore is not restricted to one-sided support of the print material 18 (upper side or lower side). On the contrary, the print material 18 may be conveyed with either side adjacent the sheet guide device. Preferably, for cleaning purposes, the guide surface 8 is detachably connected with the flow channel 17.

What is claimed is:

1. A sheet guiding device in a printing machine for guiding sheet material during travel through the printing machine, said sheet guiding device comprising:

at least one guide module that defines a guide surface having air flow openings therein over which the sheet material passes and an air flow channel communicating with said openings, a pneumatic system for generating an air flow in said flow channel and said opening communicating therewith, and a plurality of concentrically mounted directional members disposed in spaced relation to each other which define a plurality of air guide surfaces within the flow channel for directing air flow within the flow channel between said pneumatic system and said openings for effecting a substantially uniform air pressure on said guide surface during passage of said sheet material.

2. The sheet guide device of claim 1 in which said pneumatic system directs a positive pressure air flow in said flow channel and out of said guide surface openings, and said plurality of directional members direct the air flow from the pneumatic system through the openings for providing a uniform positive pressure distribution on the guide surface.

3. The sheet guide device of claim 2 in which said pneumatic system creates a suction pressure for drawing an air flow from said flow channel, and said plurality of directional members direct air flow uniformly to said pneumatic system.

4. The sheet guide device of claim 2 in which said pneumatic system is selectively and reversibly operable for positive pressure operation for generating a positive pressure in said flow channel and out of said guide surface openings and a suction operation for drawing air from said flow channel from said guide surface openings.

5. A sheet guiding device in a printing machine for guiding sheet material during travel through the printing machine, said sheet guiding device comprising:

at least one guide module that defines a guide surface having air flow openings therein over which the sheet material passes and an air flow channel communicating with said openings, a pneumatic system for generating an air flow in said flow channel and said opening communicating therewith, a plurality of concentrically mounted directional members within the flow channel for directing air flow within the flow channel between said pneumatic system and said openings for effecting a substantially uniform air pressure on said guide surface during passage of said sheet material, and at least some of said directional members having transverse air flow openings therein.

6. A sheet guiding device in a printing machine for guiding sheet material during travel through the printing machine, said sheet guiding device comprising:

at least one guide module that defines a guide surface having air flow openings therein over which the sheet material passes and an air flow channel communicating with said openings, a pneumatic system for generating an air flow in said flow channel and said opening communicating therewith, a plurality of concentrically mounted directional members within the flow channel for directing air flow within the flow channel between said pneumatic system and said openings for effecting a substantially uniform air pressure on said guide surface during passage of said sheet material, and said plurality of directional elements being concentrically arranged relative to the pneumatic system such that the spacing between said elements becomes progressively greater outwardly from the pneumatic system.

* * * * *